US007841369B1

(12) United States Patent
Osborne

(10) Patent No.: US 7,841,369 B1
(45) Date of Patent: Nov. 30, 2010

(54) WEAVING PROCESS FOR PRODUCTION OF A FULL FASHIONED WOVEN STRETCH GARMENT WITH LOAD CARRIAGE CAPABILITY

(75) Inventor: Eva Faye Osborne, New Smyrna Beach, FL (US)

(73) Assignee: vParadox LLC, Edgewater, FL (US)

( * ) Notice: Subject to any disclaimer, the term of this patent is extended or adjusted under 35 U.S.C. 154(b) by 0 days.

(21) Appl. No.: 12/591,371

(22) Filed: Nov. 18, 2009

(51) Int. Cl.
*D03D 17/00* (2006.01)
*D03D 3/02* (2006.01)
*D03C 3/12* (2006.01)
*D03C 19/00* (2006.01)
*D03D 23/00* (2006.01)

(52) U.S. Cl. ..... 139/421; 139/319; 139/327; 139/387 R; 139/390; 139/422

(58) Field of Classification Search ..... 139/59–65, 139/78, 291 R, 317–319, 327, 387 R, 388, 139/389, 390, 332, 333, 408, 410, 413, 418, 139/420 R, 421, 422, 426 R, 420 A
See application file for complete search history.

(56) References Cited

U.S. PATENT DOCUMENTS 2,772,698 A * 12/1956 Linehan, Jr ..... 139/384 R
2,998,030 A * 8/1961 Koppelman et al. ..... 139/387 R
3,360,014 A * 12/1967 Poisson et al. ..... 139/389
3,719,212 A * 3/1973 Emerson et al. ..... 139/387 R
4,410,015 A * 10/1983 Koller et al. ..... 139/383 AA
5,085,252 A * 2/1992 Mohamed et al. ..... 139/22
5,224,519 A * 7/1993 Farley ..... 139/11
5,435,352 A * 7/1995 Yamamoto et al. ..... 139/11
5,449,025 A * 9/1995 Weinberg ..... 139/11
5,465,760 A * 11/1995 Mohamed et al. ..... 139/11
5,800,514 A * 9/1998 Nunez et al. ..... 623/1.51
5,904,714 A * 5/1999 Nunez et al. ..... 139/383 R
6,123,117 A * 9/2000 Borellini ..... 139/420 A
6,129,122 A * 10/2000 Bilisik ..... 139/11
6,145,551 A * 11/2000 Jayaraman et al. ..... 139/387 R
6,148,870 A * 11/2000 Lindblom ..... 139/383 AA
6,186,185 B1 * 2/2001 Khokar ..... 139/1 R
6,315,007 B1 * 11/2001 Mohamed et al. ..... 139/11
6,315,009 B1 * 11/2001 Jayaraman et al. ..... 139/387 R
6,338,367 B1 * 1/2002 Khokar ..... 139/11
6,349,750 B1 * 2/2002 Fujiwara ..... 139/384 R
6,389,850 B1 * 5/2002 Fujiwara ..... 66/176
6,431,222 B1 * 8/2002 Khokar ..... 139/383 R
6,470,916 B1 * 10/2002 Uchida et al. ..... 139/11
6,595,244 B1 * 7/2003 Sollars, Jr. ..... 139/389
6,712,099 B2 * 3/2004 Schmidt et al. ..... 139/383 R
6,742,547 B2 * 6/2004 Bryn et al. ..... 139/383 R
6,883,555 B1 * 4/2005 Speich ..... 139/294
6,886,603 B2 * 5/2005 Uchida et al. ..... 139/11
6,892,766 B2 * 5/2005 Bryn et al. ..... 139/11
7,073,538 B2 * 7/2006 Bhatnagar et al. ..... 139/383 R
7,077,167 B2 * 7/2006 Nayfeh et al. ..... 139/11
7,086,424 B2 * 8/2006 Debaes et al. ..... 139/418
7,350,861 B2 * 4/2008 Zaharakos ..... 297/228.1
7,628,179 B2 * 12/2009 Mohamed ..... 139/11
2006/0054236 A1 * 3/2006 Berger et al. ..... 139/59
2006/0249217 A1 * 11/2006 Nayfeh et al. ..... 139/11
2007/0107796 A1 * 5/2007 Nayfeh et al. ..... 139/11

* cited by examiner

*Primary Examiner*—Bobby H Muromoto, Jr.

(57) ABSTRACT

A weaving process for constructing weft stretch full fashioned utility garments using a jacquard machine, an electronic loom and highly stretchable elastomeric fill yarns.

12 Claims, 15 Drawing Sheets

WEAVING PROCESS FOR PRODUCTION OF A FULL FASHIONED WOVEN STRETCH GARMENT WITH LOAD CARRIAGE CAPABILITY

CROSS REFERENCE TO RELATED APPLICATION

U.S. patent application Ser. No. 12/591,373 for: Process for Imparting High Stretch, Recovery and Modulus into a Woven Fabric; Eva Osborne U.S. patent application Ser. No. 12/591,374 for: Zipper and Buckle Component for Weft Stretch Fabric; Eva Osborne U.S. patent application Ser. No. 12/591,372 for: Weaving Connectors for Three Dimensional Textile Products; Eva Osborne

BACKGROUND OF THE INVENTION

In general, fabrics are woven in two dimensions. The warp and fill interlace in a single plane which results in a fabric that has various decorative and surface characteristics. More complex structures for three dimensional fabrics can be created through two processes of double weaving: weaving double weaves in the fill direction which results in tubes across the machine direction as seen in U.S. Pat. No. 3,970,116 to Takada et al (1976) or weaving double in the warp direction with a shuttle loom which produces helical circular fabrics in the machine direction as demonstrated in U.S. Pat. No. 5,414,204 to Kitamura et al (1995). Even greater geometric complexity can be realized in U.S. Pat. No. 4,668,545 to Lowe (1987) with three dimensional shaped products can be produced by adjusting spacing between the warp and fill yarns at critical interlaces and redirecting the geometry. Other relevant multi-layer weave structures have been produced to create open spaces for electronics in U.S. Pat. No. 7,144,830 to Hill et al (2006).

Full Fashion seamless shirts have been produced on shuttle looms in order to eliminate side seams in U.S. Pat. No. 6,145,551 to Jayaramen et al (2000). The elimination of the side seam is particularly advantageous when producing garments that contain yarns requiring continuous weaving. Such yarns would be those that contain optics, electronics, metal, or glass.

The object of this invention is to provide a weaving process for the production of full fashioned stretch woven garments which can incorporate multiple layers and sizes of pouches. The pouches are capable of carrying supplies and equipment next to the body. The garment is produced on a jacquard machine with an electronic shuttle-less loom.

While shuttle looms provide the mechanism to produce seamless weaving they do not have a high level of control over the set tensions of the fill yarns. Tension control is particularly critical when weaving elastomeric yarns with a high degree of extension. In the case of a shuttle loom it is the winding of the fill yarn onto a pirn that does not give any measure of uniformity in the amount of stretch. For rigid yarns this is not a critical issue, however, for elastomeric yarns the pirns are not capable of controlling a consistent distribution of tension from selvage to selvage, pick to pick, or pirn to pirn.

In order to produce a garment that can compress weighted objects close to the body and maintain body comfort the performance characteristic that are required are: controlled modulus, consistent level of stretch and good recovery. In addition, the high modulus and stretch capacities require extremely high stability and strength at any seam location where the stretch yarns are being stressed. Sewn seems often exhibit snap back, grinning, breaks, and yarn slippage at the seam line for compression garments. Therefore, a need exists for a process to produce such a full fashion stretch garment which eliminates critical cut and sew operations across the stretch direction for high modulus compression garments.

Accordingly, it is a primary objective of the present invention to provide full fashioned garments having such desirable attributes as outlined above.

SUMMARY OF THE INVENTION

The object of this invention is to provide a process for producing woven fill stretch utility garments comprised of a single integrated piece.

The garment can exhibit but is not limited to: numerous layers, different sized pouch sites, performance characteristics of 90% stretch or greater and 90% recovery or better and a modulus ranging between 1 to 4. The shape and function of the garment is achieved by utilizing multiple single weave, multiple double weaves in the machine and cross-machine directions with three dimensional weaving connectors on multiple layers of fabric and mirror imaging jacquard patterning while controlling tension properties of the elastomeric fill yarns.

It is a further object of the invention to be able to fashion a garment on the loom which can accommodate changes for both shape and size on tops and bottoms.

It is a further object of the present invention to have the option of utilizing specially designed closure mechanisms to facilitate ease of use for said garments with high compressive force.

The innovative facet of this garment lies in the adaptation of the basic functionalities in each phase of the garment forming process; from fiber to fashion. The shaping of the garment through stretch performance is produced via the controlled tension of an elastomeric core spun yarn (U.S. patent application Ser. No. 12/591,373 for: Process for Imparting High Stretch, Recovery and Modulus into a Woven Fabric). Attaching the single and double weaves in multiple layered positions is achieved through the use of three dimensional connectors (U.S. patent application Ser. No. 12/591,372 for: Weaving Connectors for Three Dimensional Textile Products). The fabric pattern and garment pattern are accomplished by exploiting the non restrictive patterning repeat size in the warp direction of an electronic jacquard machine. The warp end capacity and the width on an electronic loom mandate the width and stretch control. The shuttle-less loom weft insertion with electro-mechanical weft selectors fully synchronizes the different yarns to ensure correct mixing with individual tension controls across each shed. The garment patterning provides multiple folding operations and mirror imaging while taking advantage of the independent weave interlaces on the face-side and back-side fabric surface areas. The thermoplastic nature of the fiber provides a mechanism for pouch openings within a formed product. The specially designed closure mechanisms (U.S. patent application Ser. No. 12/591,374 for: Zipper and Buckle Component for Weft Stretch Fabrics) allows for the donning and disrobing, stop sites, multiple access points, and back-up for zipper failure.

In one particular embodiment, a utility vest was produced in accordance with the present invention. The garment exhibits 16 layers, 44 pouches, adjustable hook and loop shoulder straps, 2 center front 4 headed 2-way separating hooked tape zipper components for internal pocket access, two one-way double ended zipper components on the back for internal access, a 3.0 modulus within the pouch areas, 200% stretch, 95% recovery using a core spun elastomeric yarn. The armholes, neckline and pocket openings were heat sealed. The construction of the vest required an electronic Jacquard machine with 2688 hooks for an electronic loom with harnesses and springs for 9600 ends and 8 electronic feeders for weft insertion.

It can be seen from the description herein of the present invention that a full fashioned woven product can be made which accommodates multiple layers, multiple pouches, compression, stretch and recovery properties required for supporting supplies and equipment next to the body. These and other objects with their advantages will become apparent upon reading the following specification and claims in conjunction with the accompanying figure drawings.

DETAILED DESCRIPTION OF THE ILLUSTRATIVE EMBODIMENTS

Referring to the above figure drawings, the full-fashioned weaving process and product of the present invention will be described in detail.

Figure 1:
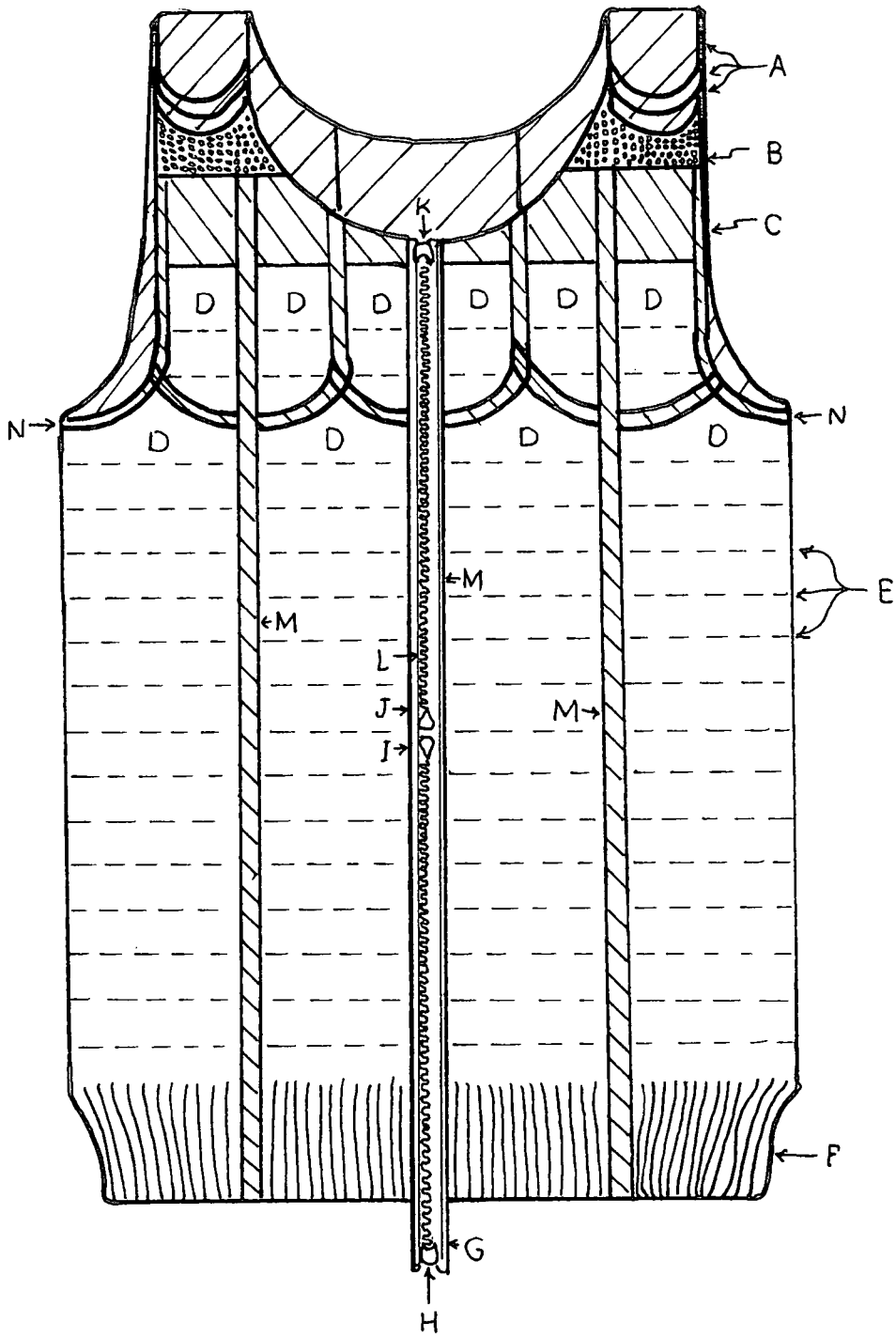
FIG. 1 Full view front
FIG. 2 Full view back
FIG. 3 Open inside view relaxed with fold diagrams
FIG. 4 Open inside view stretched 100%
FIG. 5 Vertical cut away
FIG. 6 Horizontal cut away
FIG. 7 Full length pattern front layer 1 face-side
FIG. 8 Full length pattern front layer 1 back-side
FIG. 9 Full length pattern front layer 2 face-side
FIG. 10 Full length pattern front layer 2 back-side
FIG. 11 Full length pattern back layer 3 face-side
FIG. 12 Full length pattern back layer 3 back-side
FIG. 13 Full length pattern back layer 4 face-side
FIG. 14 Full length pattern back layer 4 back-side
FIG. 15 Accessible pocket construction
FIG. 16 Gathered Plain weave construction
FIG. 17 Elastic banding construction
FIG. 18 Tie downs for layer to layer garment fabrication
FIG. 19 Closure component placement and use for zipper and hook & loop

FIG. 1 illustrates the front view of the full-fashioned stretch woven garment made in accordance with the present invention.

Figure 2:
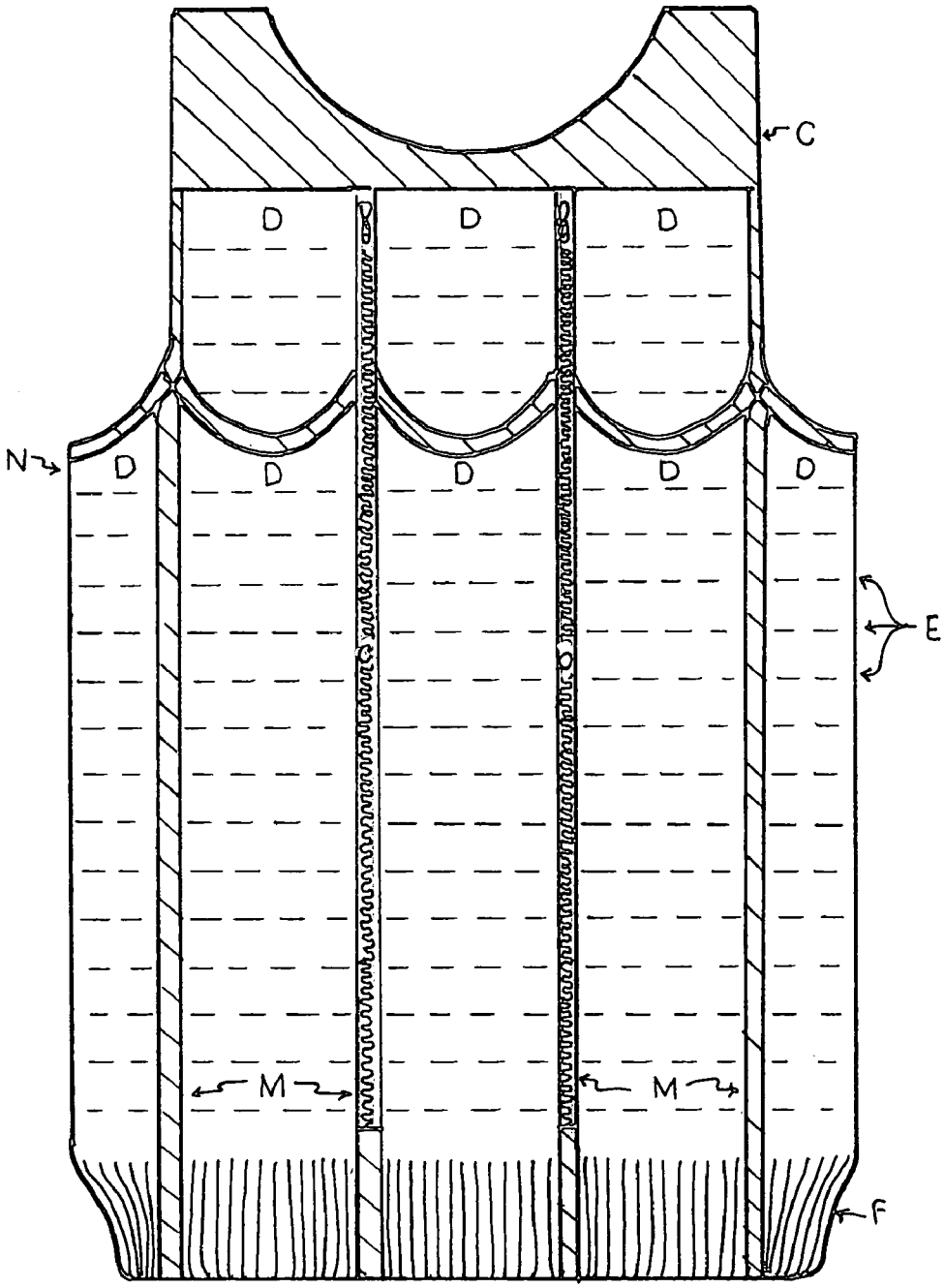

A. The adjustable back shoulder strap lapped over the front shoulder strap
B. The adjustable front shoulder strap with air-entangled elastomeric yarn used as loop device for hook-loop closure
C. Layer 1 & 2 woven together to form yoke in 2:2 plain weave
D Backside of concealed pouches in Layers 1 & 2
E Gathering with plain weave on Layer 2 in pouch area
F. Alternating single layer weave on layer 2 with banded tie down sections on layers 1 & 2 and backed by a modified crepe weave in layer 1
G. Extended zipper tape to facilitate donning the garment from bottom up. The extension reduces the compression forces on the zipper teeth during start up
H. Bottom female slide for 4 way separating zipper
I. Bottom male slide for 4 way separating zipper
J. Top male slide for 4 way separating zipper
K. Top female slide for 4 way separating zipper
L. Zipper Tape
M. Layers 1 & 2 woven together for zipper placement and pouch placement
N. Layers 1 & 2 woven together for armcye placement and pouch placement FIG. 2 illustrates the back view of the full-fashioned stretch woven garment made in accordance with the present invention.

Figure 3:
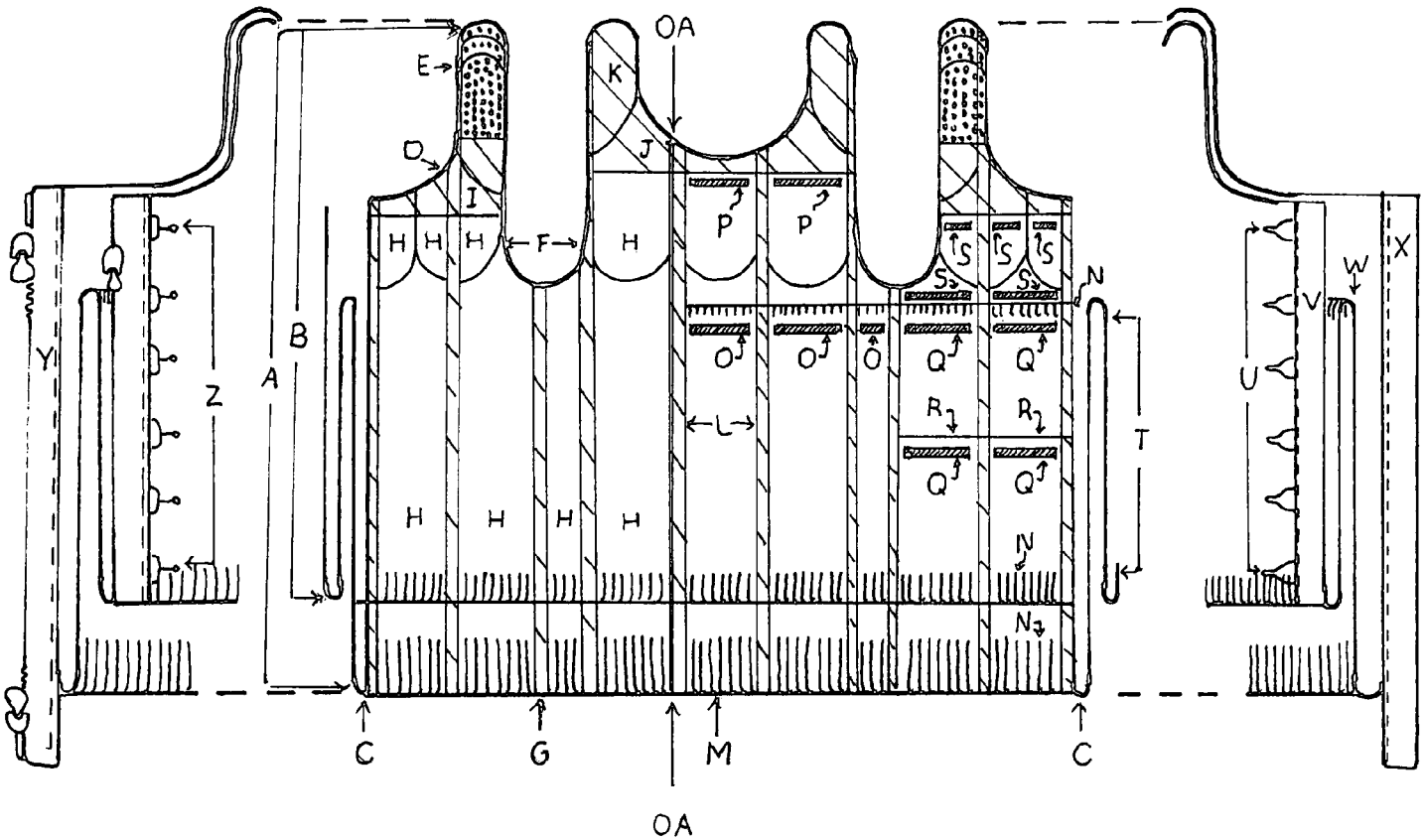

C. Back yoke with on Layers 3 & 4 woven together
D. Backside of concealed pouches in Layers 3 & 4
E. Gathering with plain weave on Layer 3 in pouch area
F. Alternating single layer weave on layer 3 with banded tie down sections on layers 3 & 4 and backed by a modified crepe weave in layer 4
M. Layers 1 & 2 woven together for zipper placement and pouch placement
N. Layers 1 & 2 woven together for armcye placement and pouch placement FIG. 3 illustrates the open inside view of the flat garment in the relaxed position. Shown are the multiple pouch sites on layer 1 face-side on the right side of the illustration. On the left side of the illustration layer 1 backside is exhibited without the pouch openings and cummerbund exposed. Also illustrated with the broken lines are the corresponding folding diagrams that create the inside waist length vest, cummerbund and outside hip length vest. The zipper and closure mechanisms with placement are shown in the cut away side views. Further detail is outlined as follows:

A. Center front of the garment and neckline exhibiting the position of the hip length vest
B. Center front of the garment and neckline exhibiting the position of the waist length vest
C. Center front of the garment exhibiting the folding diagram for the vests and cummerbund
D. Front neckline,
E. Front shoulder strap with placement markings and woven loop construction
F. Armcye
G. Side seam
H. Back sides of the internal pouch areas
I. Front yoke woven together with layers 1 & 2
J. Back yoke woven together with layers 3 & 4
K. Back shoulder-strap
L. Back zipper line and pouch placement
M. Center back
N. 3 banding areas: hip line, waist line, chest line
O. Layer 3 inside back cummerbund pouch openings
P. Layer 3 inside back hip length vest pouch openings
Q. Inside front cummerbund pouch openings
R. Inside front cummerbund weft pouch line Layer 1
S. Layer 1 outside hip length vest pouch openings
T. Cut away illustration of folds for one side of cummerbund
U. Female side of closure mechanisms
V. Waist length vest 2 way separating zipper
W. Waist length vest fold to cummerbund fold to hip length vest
X. Hip Length vest 4 way separating zipper
Y. Slider side of 4 way separating zipper for hip length vest
Z. Male side of closure mechanism
OA. Change from view of internal pouch and cummerbund illustration to internal waist length vest backside.

Figure 4:
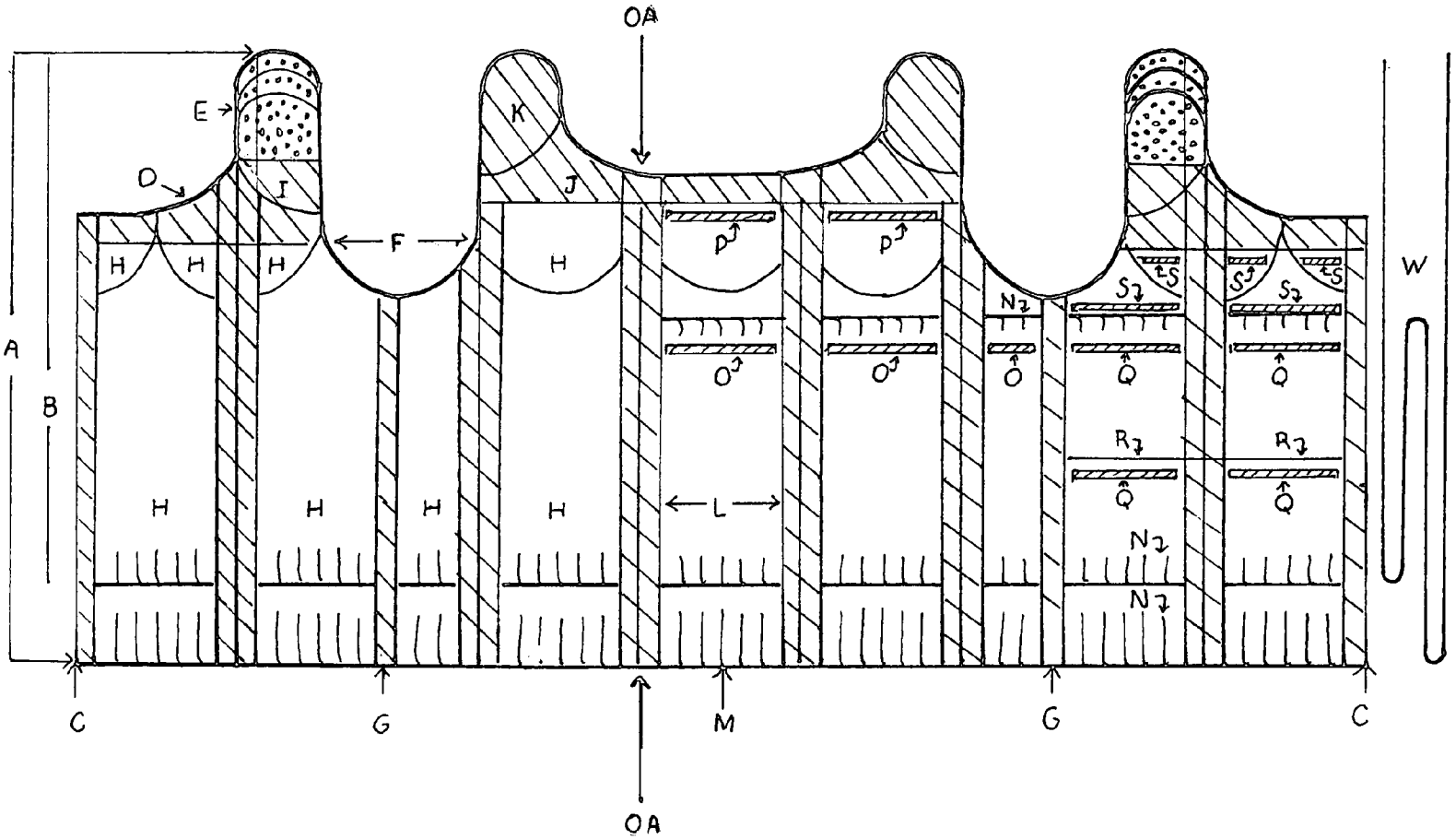

FIG. 4 illustrates the open inside view of the flat garment in FIG. 3 stretched 100%.

A. Center front of the garment and neckline exhibiting the position of the hip length vest
B. Center front of the garment and neckline exhibiting the position of the waist length vest C. Center front of the garment exhibiting the folding diagram for the vests and cummerbund
D. Front neckline
E. Front shoulder strap with placement markings and woven loop construction
F. Armcye
G. Side seam
H. Back sides of the internal pouch areas
I. Front yoke woven together with layers 1 & 2
J. Back yoke woven together with layers 3 & 4
K. Back shoulder-strap
L. Back zipper line and pouch placement
M. Center back
N. 3 banding areas: hip line, waist line, chest line
O. Layer 3 inside back cummerbund pouch openings
P. Layer 3 inside back hip length vest pouch openings
Q. Inside front cummerbund pouch openings
R. Inside front cummerbund weft pouch line Layer 1
S. Layer 1 outside hip length vest pouch openings
W. Waist length vest fold to cummerbund fold to hip length vest
OA. Change from view of internal pouch and cummerbund illustration to internal waist length vest backside.

Figure 5:
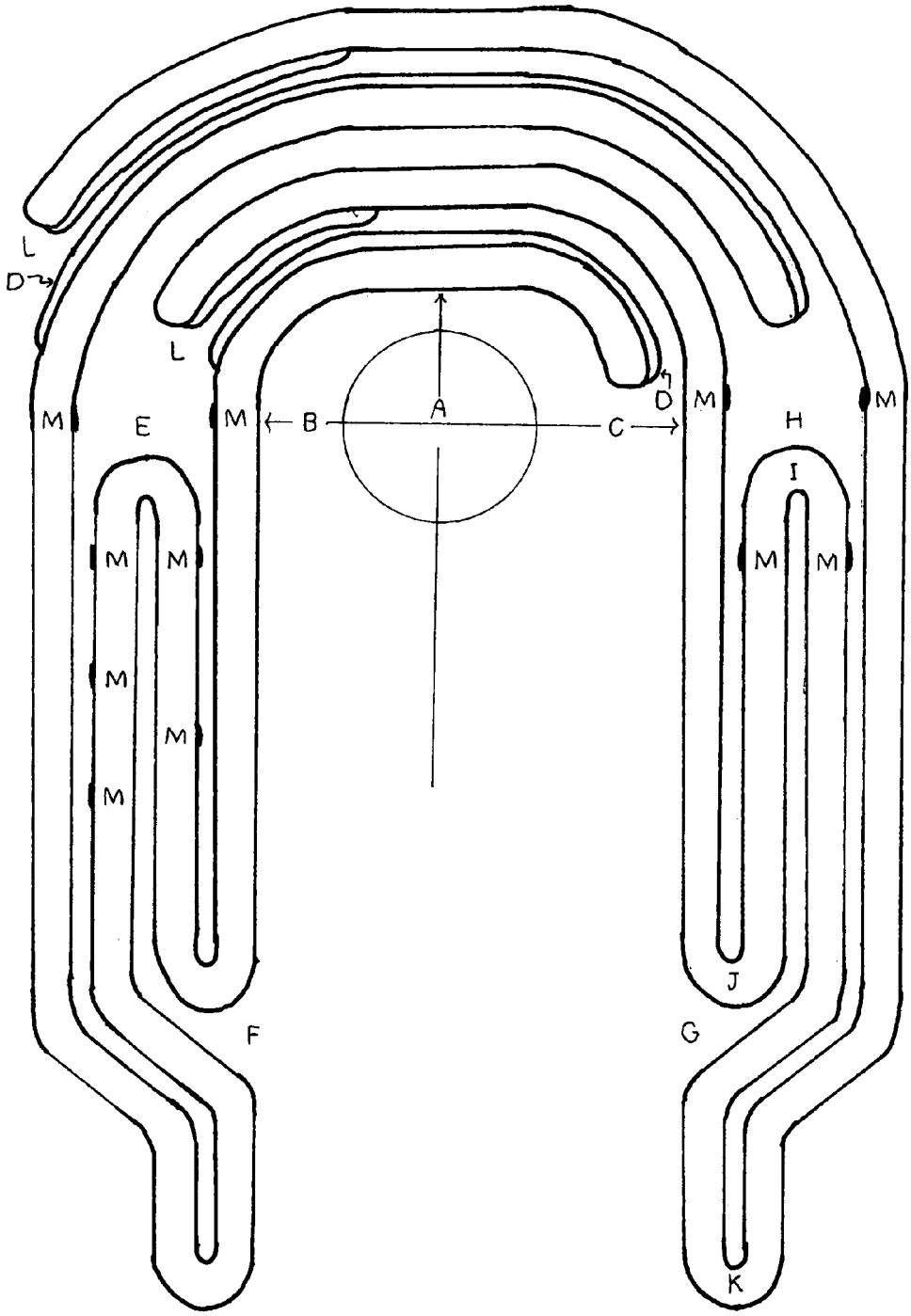

FIG. 5 illustrates the vertical cut away view of the front and back folds with shoulder placement.

Figure 6:
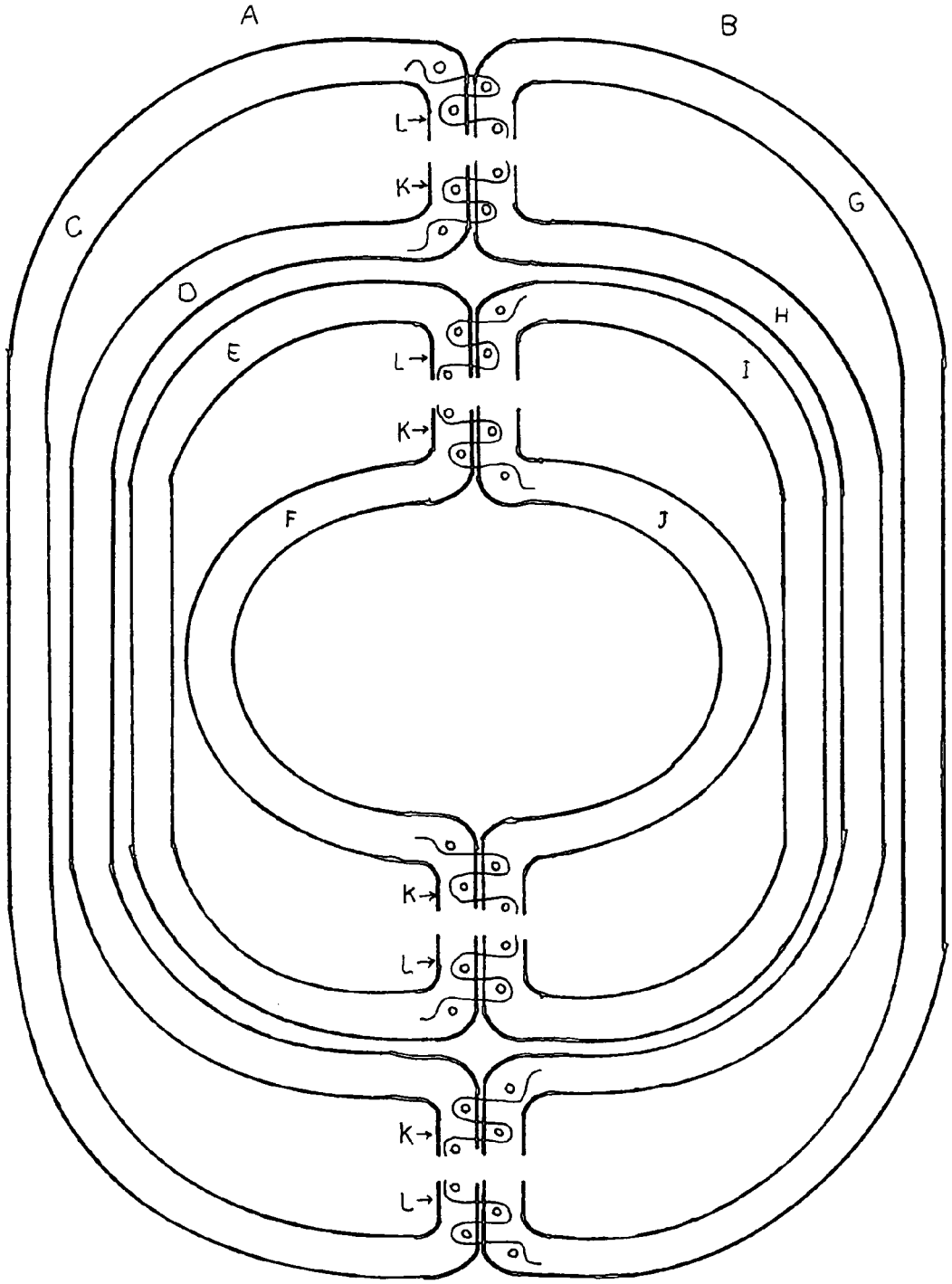

A. Location of side view of a human body with arm position
B. Front of body
C. Back of body
D. Loops created through air entangled elastomeric yarn, serves as connection point to sewn hook for hook/loop formation
E. Layer 1 face-side
F. Layer 2 back-side
G. Layer 3 back-side
H. Layer 4 face-side
I. Top of cummerbund banding
J. Bottom band of waist length vest
K. Bottom band of hip length vest
L. Sewn hook side of hook/loop closure
M. Pouch openings FIG. 6 illustrates the horizontal view of vest bottom cut away in the machine direction to demonstrate side seam formation with leno weave and inside out folding for waist length vest to hip length vest.

Figure 7:
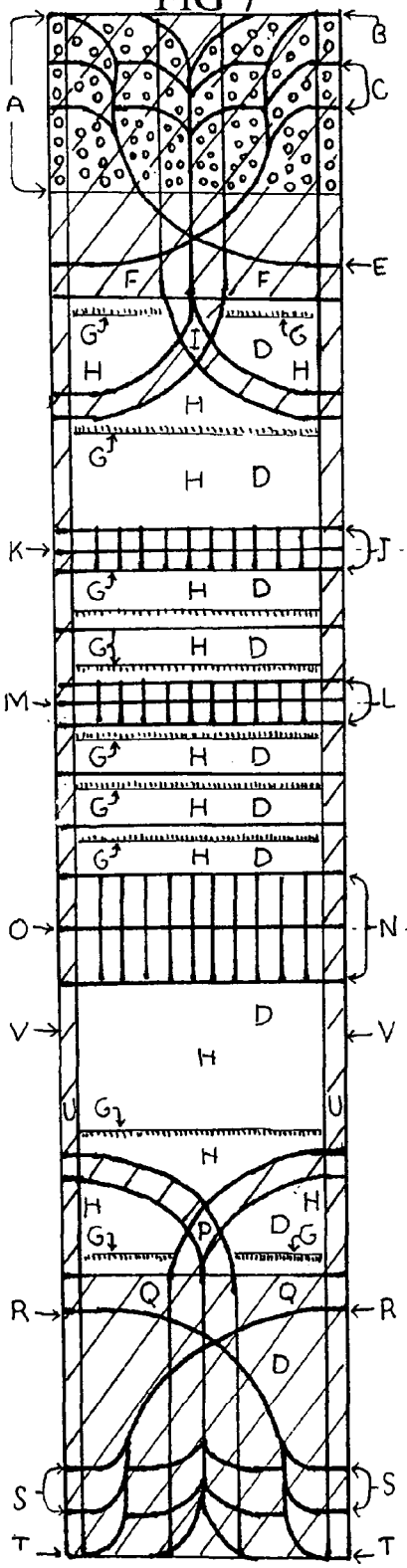

A. Front of vest
B. Back of vest
C. Layers 1 & 2 of front hip length vest
D. Layers 1 & 2 of front outside cummerbund
E. Layers 1 & 2 of front inside cummerbund
F. Layers 1 & 2 of front waist length vest
G. Layers 3 & 4 of back hip length vest
H. Layers 3 & 4 of back outside cummerbund
I. Layers 3 & 4 of back inside cummerbund
J. Layers 3 & 4 of back waist length vest
K. Side seam Leno weave of Layers 1, 2, 3 & 4 together in cross machine direction
L. Side seam Leno weave of Layers 1, 2, 3 & 4 together inside out of cross machine direction FIG. 7 is the representative placement and weave structure for component parts for the front of the garment. This figure is an exhibit of the full length pattern repeat in Layer 1 face-side in the machine direction. The full width requires 4 repeats in the cross machine direction.

A. Air entangled elastomeric yarn for loop formation
B. Shoulder cut line 2:2 plain for waist length vest
C. Shoulder placement marking 2:2 plain for waist length vest
D. Layers 1 & 2 Pouch front created with 1:1 plain weave supported by 1:3 float every vertical inch
E. Neck cut line 2:2 plain for waist length vest
F. Mirrored image for yoke formation 2:2 plain for waist length vest
G. Pouch openings with ¼" warp float
H. Different pouch sizes created through weaving layers 1 & 2 together at pouch lines.
I. Stabilized area of cutline for front armcye for waist length vest
J. Bottom band for waist length vest, alternating 1:1 single layer plain weave with mod crepe and tie down weaves on layers 1 & 2 approximately every 0.75"
K. 2:2 plain weave on layers 1 & 2 together creating fold line of band
L. Top band for cummerbund
M. Fold line for top band
N. Bottom band for outside hip length vest
O. Fold line for bottom band
P. Stabilized area of cutline for front armcye for hip length vest, 2:2 plain weave for Layers 1 & 2 together
Q. Mirrored image for yoke formation 2:2 plain on layers 1 & 2 together for hip length vest
R. Neck cut line 2:2 plain Layers 1 & 2 together for hip length vest
S. Shoulder placement marking 2:2 plain on Layers 1 & 2 together for hip length vest
T. Shoulder cut line 2:2 plain on layers 1 & 2 together for waist length vest
U. 2:2 plain weave on layers 1 & 2 together for pouch site and zipper placement
V. Selvage leno weave for layers 1, 2, 3, & 4

Figure 8:
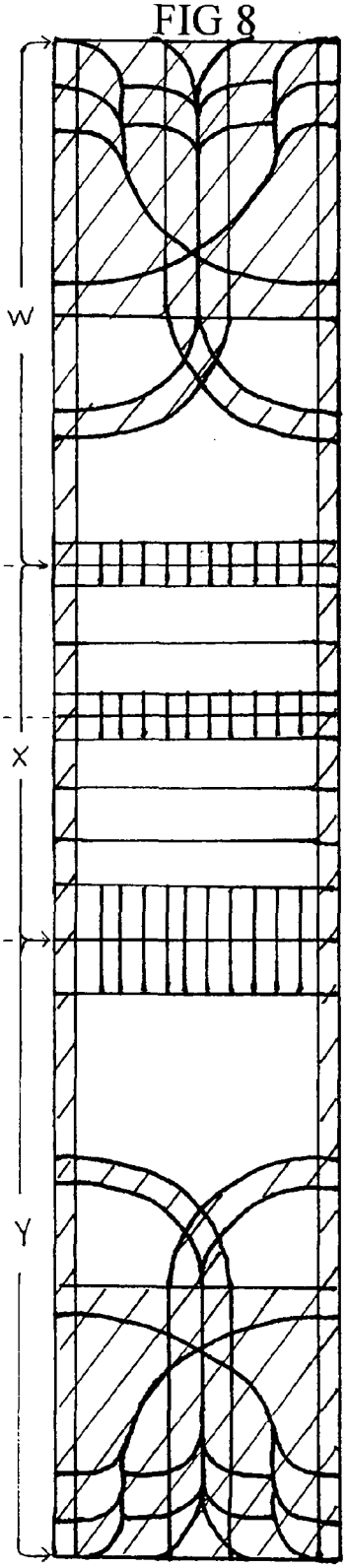

FIG. 8 is a representative placement and weave structure for component parts for the front of the garment. This figure is an exhibit of the full length pattern repeat in Layer 1 back-side in the machine direction. The full width requires 4 repeats in the cross machine direction. The back side of the fabric duplicates the face-side of the fabric with the exception of the elimination of the pouch opening sites and the float lengths of the air entangled elastomeric yarn at the shoulder of the waist length vest.

Figure 9:
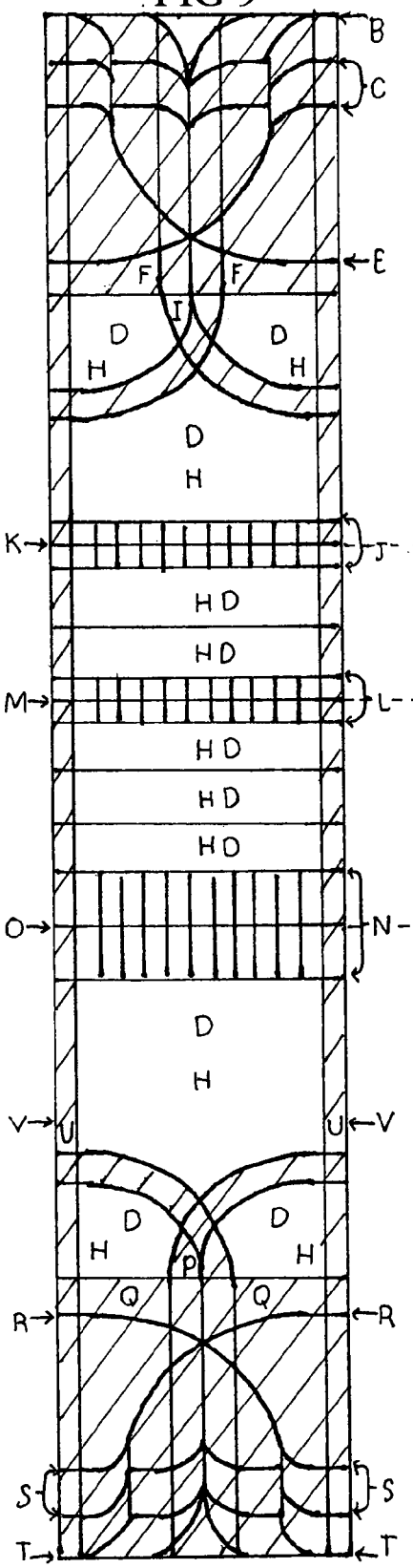

W. Pattern for Waist Length Vest
X. Pattern for Cummerbund
Y. Pattern for Hip Length Vest
Z. Warp or machine direction FIG. 9 is a representative placement and weave structure for component parts of the front of the garment. This figure is an exhibit of the full length pattern repeat in Layer 2 face-side in the machine direction. The full width requires 4 repeats in the cross machine direction. Layer 2 face-side duplicates the face-side of layer 1 with the exception of the elimination of the pouch opening sites, the placement of the air-entangled elastomeric yarn at the shoulder of the hip length vest and the weave type on the band.

B. Shoulder cut line 2:2 plain for waist length vest
C. Shoulder placement marking 2:2 plain for waist length vest
D. Layers 1 & 2 Pouch front created with 1:1 plain weave supported by 1:3 float every vertical inch.
E. Neck cut line 2:2 plain for waist length vest
F. Mirrored image for yoke formation 2:2 plain for waist length vest
H. Different pouch sizes created through weaving layers 1 & 2 together at pouch lines.

I. Stabilized area of cutline for front armcye for waist length vest
J. Bottom band for waist length vest, alternating 1:1 single layer plain weave with mod crepe and tie down weaves on layers 1 & 2 approximately every 0.75"
K. 2:2 plain weave on layers 1 & 2 together creating fold line of band
L. Top band for cummerbund
M. Fold line for top band
N. Bottom band for outside hip length vest
O. Fold line for bottom band
P. Stabilized area of cutline for front armcye for hip length vest, 2:2 plain weave for Layers 1 & 2 together
Q. Mirrored image for yoke formation 2:2 plain on layers 1 & 2 together for hip length vest
R. Neck cut line 2:2 plain Layers 1 & 2 together for hip length vest
S. Shoulder placement marking 2:2 plain on Layers 1 & 2 together for hip length vest
T. Shoulder cut line 2:2 plain on layers 1 & 2 together for waist length vest
U. 2:2 plain weave on layers 1 & 2 together for pouch site and zipper placement
V. Selvage leno weave for layers 1, 2, 3, & 4

Figure 10:
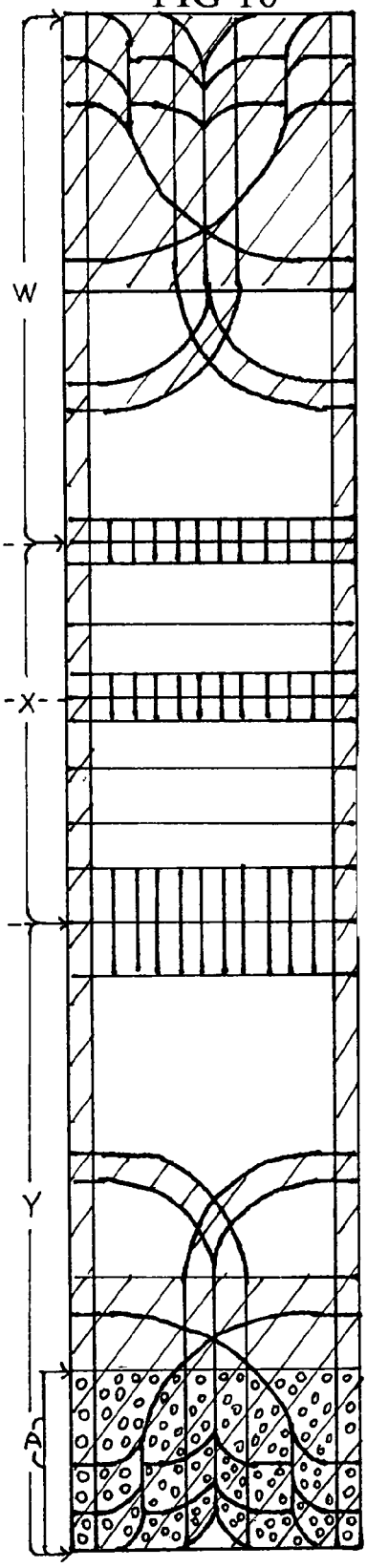

FIG. 10 is a representative placement and weave structure for component parts for the front of the garment. This figure is an exhibit of the full length pattern repeat in Layer 2 back-side in the machine direction. The full width requires 4 repeats in the cross machine direction. The back side of the fabric duplicates the face-side of the fabric with the exception of the float lengths on the face-side when weaving with the air entangled elastomeric yarn at the shoulder in the hip length vest.

Figure 11:
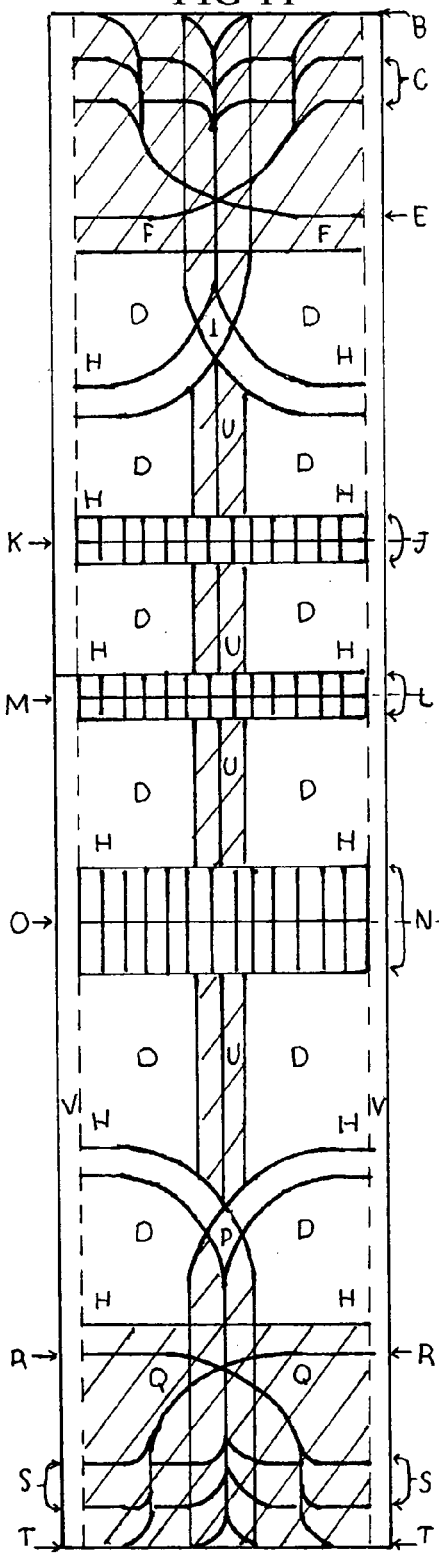

A. Air entangled elastomeric yarn for loop formation
W. Pattern for Waist Length Vest
X. Pattern for Cummerbund
Y. Pattern for Hip Length Vest
Z. Warp or Machine direction FIG. 11 is a representative placement and weave structure for component parts for the back of the garment. This figure is an exhibit of the full length pattern repeat in Layer 3 face-side in the machine direction. The full width requires 4 repeats in the cross machine direction.

Figure 12:
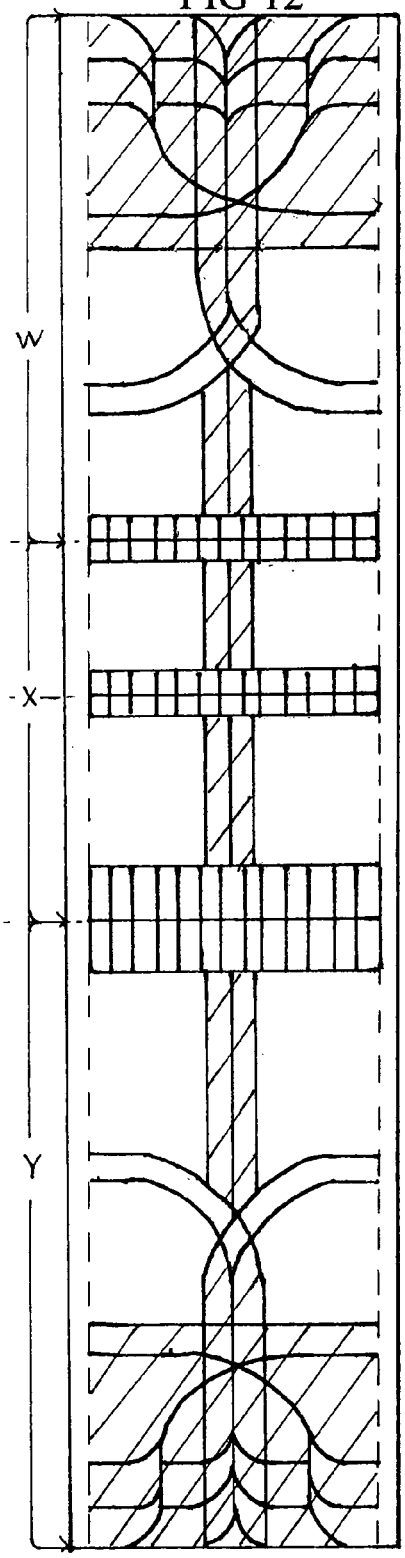

A. Shoulder cut line 2:2 plain for waist length vest
B. Shoulder placement marking 2:2 plain for waist length vest
C. Layers 3 & 4 Pouch created with 1:1 plain weave supported by 1:3 float every vertical inch.
D. Neck cut line 2:2 plain for waist length vest
E. Mirrored image for yoke formation 2:2 plain for waist length vest
H. Different pouch sizes created through weaving layers 3 & 4 together at pouch lines-pouch back created with 1:1 plain weave supported by 1:3 float every vertical inch (F1 thru 12)
I. Stabilized area of cutline for back armcye for waist length vest woven as single layer in 2:2 plain in order to facilitate the tunnel opening for larger bodies of equipment
J. Bottom band for waist length vest. Alternating 1:1 single layer plain weave with 2:2 plain weave on layers 3 & 4 together
K. 2:2 plain weave on layers 3 & 4 together creating fold line of band
L. Top band for cummerbund
M. Fold line for top band
N. Bottom band for outside hip length vest
O. Fold line for bottom band
P. Stabilized area of cutline for back armcye for waist length vest woven as single layer in 2:2 plain in order to facilitate the tunnel opening for larger bodies of equipment
Q. Mirrored image for yoke formation 2:2 plain on layers 3 & 4 together for hip length vest
R. Neck cut line 2:2 plain Layers 3 & 4 together for hip length vest
S. Shoulder placement marking 2:2 plain on Layers 3 & 4 together for hip length vest
T. Shoulder cut line 2:2 plain on layers 3 & 4 together for waist length vest
U. 2:2 plain weave on layers 3 & 4 together for pouch site and zipper placement
V. Selvage leno weave for layers 1, 2, 3, & 4
W. Left selvage leno weave for layers 1, 2, 3, & 4
X. Warp or machine direction FIG. 12 is a representative placement and weave structure for component parts of the back of the garment. This figure is an exhibit of the full length pattern repeat in Layer 3 back-side in the machine direction. The full width requires 4 repeats in the cross machine direction. Layer 3 back-side duplicates the face-side of layer 3.

Figure 13:
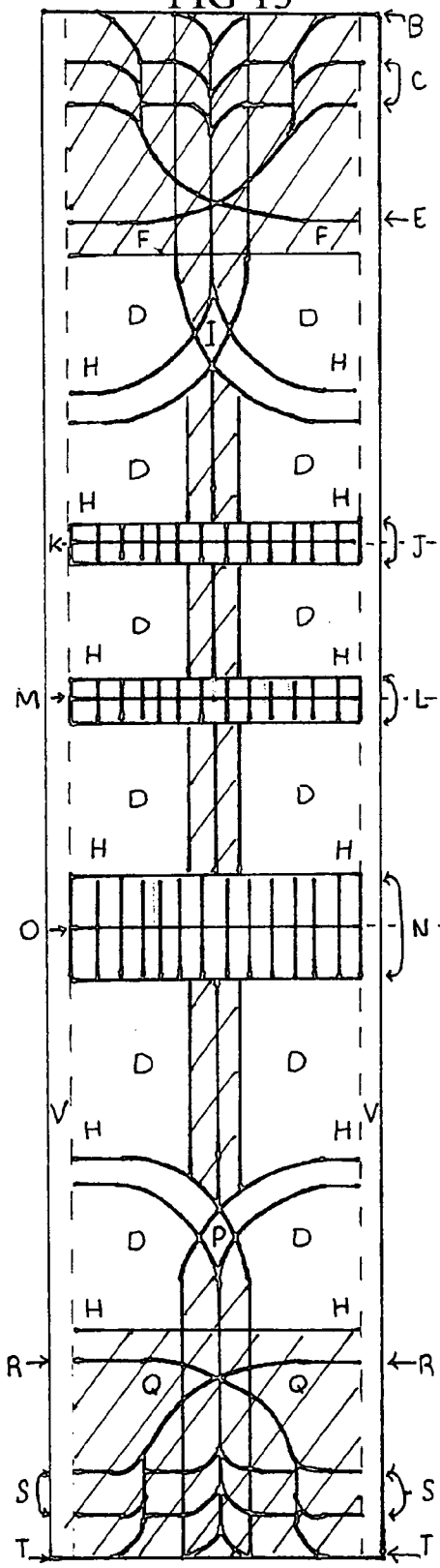

W. Pattern for waist length vest
X. Pattern for cummerbund
Y. Pattern for hip length vest
Z. Warp or machine direction FIG. 13 is a representative placement and weave structure for component parts of the back of the garment. This figure is an exhibit of the full length pattern repeat in Layer 4 face-side in the machine direction. The full width requires 4 repeats in the cross machine direction. Layer 4 face-side duplicates the face-side of layer 3 with the exception of the weave type on the band.

B. Shoulder cut line 2:2 plain for waist length vest
C. Shoulder placement marking 2:2 plain for waist length vest
D. Layers 3 & 4 Pouch created with 1:1 plain weave supported by 1:3 float every vertical inch Neck cut line 2:2 plain for waist length vest
E. Back neck cut line
F. Mirrored image for yoke formation 2:2 plain for waist length vest
H. Different pouch sizes created through weaving layers 3 & 4 together at pouch lines
I. Stabilized area of cutline for back armcye for waist length vest woven as single layer in 2:2 plain in order to facilitate the tunnel opening for larger bodies of equipment
J. Bottom band for waist length vest. Alternating a single layer crepe weave with 2:2 plain weave on layers 3 & 4 together
I. 2:2 plain weave on layers 3 & 4 together creating fold line of band
J. Top band for cummerbund
K. Fold line for top band
L. Bottom band for outside hip length vest
M. Fold line for bottom band
N. Bottom band for outside hip length vest
O. Fold line for bottom band
P. Stabilized area of cutline for back armcye for waist length vest woven as single layer in 2:2 plain in order to facilitate the tunnel opening for larger bodies of equipment
Q. Mirrored image for yoke formation 2:2 plain on layers 3 & 4 together for hip length vest R. Neck cut line 2:2 plain Layers 3 & 4 together for hip length vest S. Shoulder placement marking 2:2 plain on Layers 3 & 2 together for hip length vest T. Shoulder cut line 2:2 plain on layers 3 & 4 together for waist length vest U. 2:2 plain weave on layers 3 & 4 together for pouch site and zipper placement V. Selvage leno weave for layers 1, 2, 3, & 4

Figure 14:
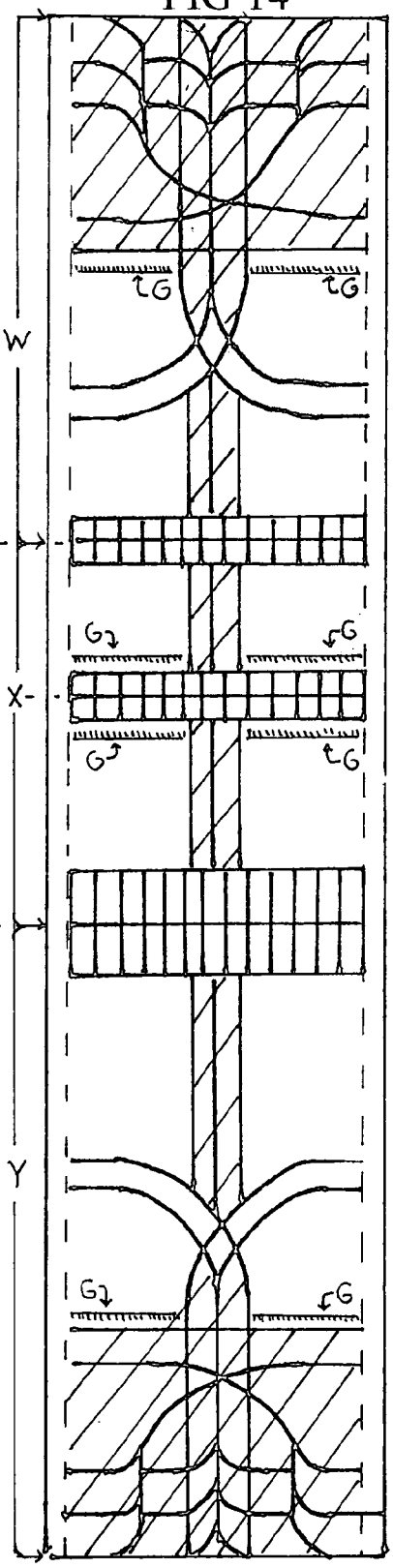

FIG. 14 is a representative placement and weave structure for component parts of the back of the garment. This figure is an exhibit of the full length pattern repeat in Layer 4 back-side in the machine direction. The full width requires 4 repeats in the cross machine direction. Layer 4 back-side duplicates the face-side of layer 4 with the exception of the warp floats for the pouch opening sites.

G. Pouch openings with ¼ warp float

W. Pattern for waist length vest

X. Pattern for cummerbund

Y. Pattern for hip length vest

Z. Warp or machine direction

Figure 15:
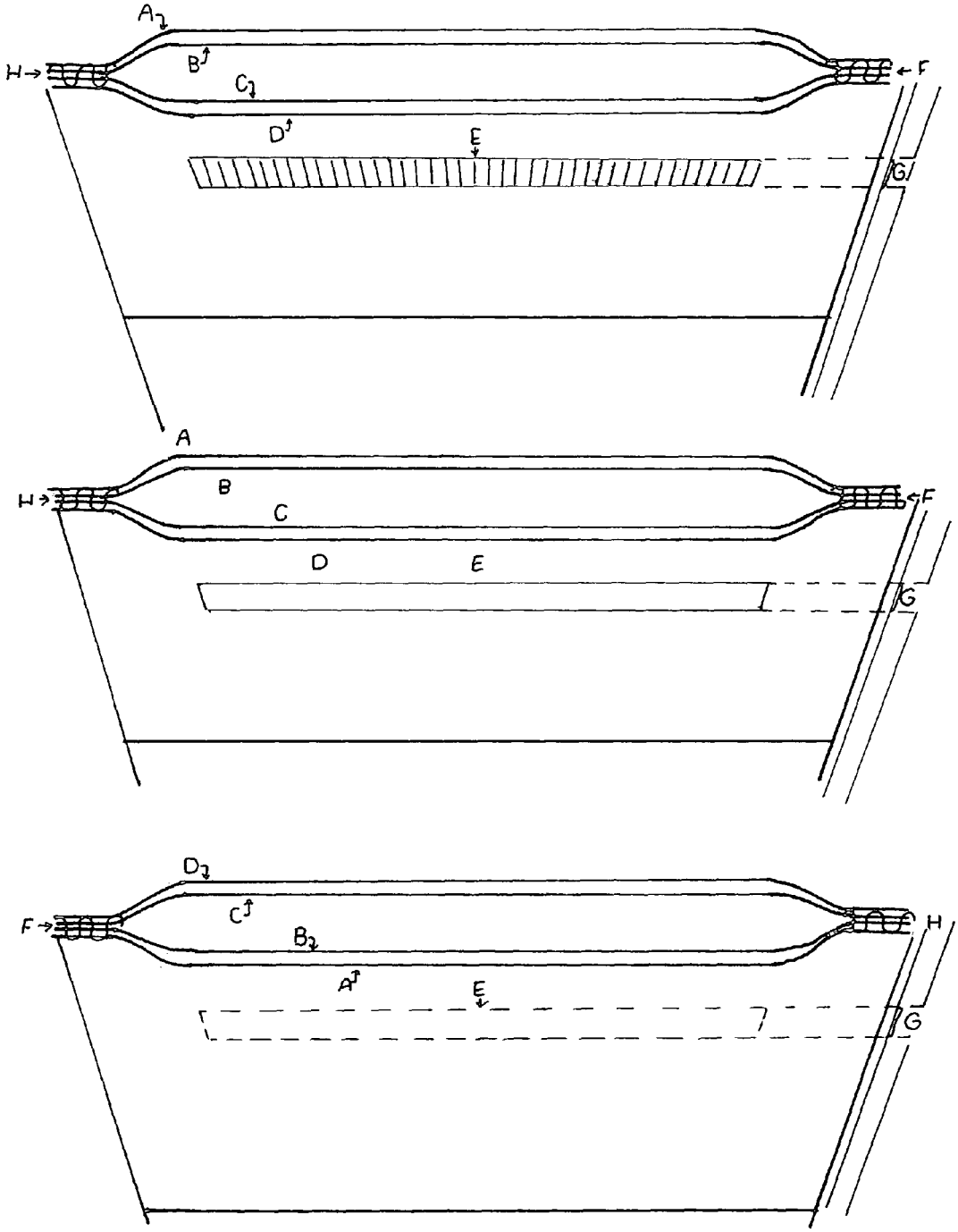

FIG. 15 illustrates the construction of the pocket openings between the layers. In this drawing there are four layers, A, B, C, and D which have been simultaneously and independently woven with all four layers connected at points F and H. In the top view on the back side of layer D are warp floats E. The fill yarns behind warp float yarns E are subsequently woven into the front side of layer C (see side view G). In the second view the warp floats are exposed to a thermal melting mechanism such as heat or ultra-sonics, the construction will result in a slit. The bottom view represents the unaltered appearance of layers A and B.

Figure 16:
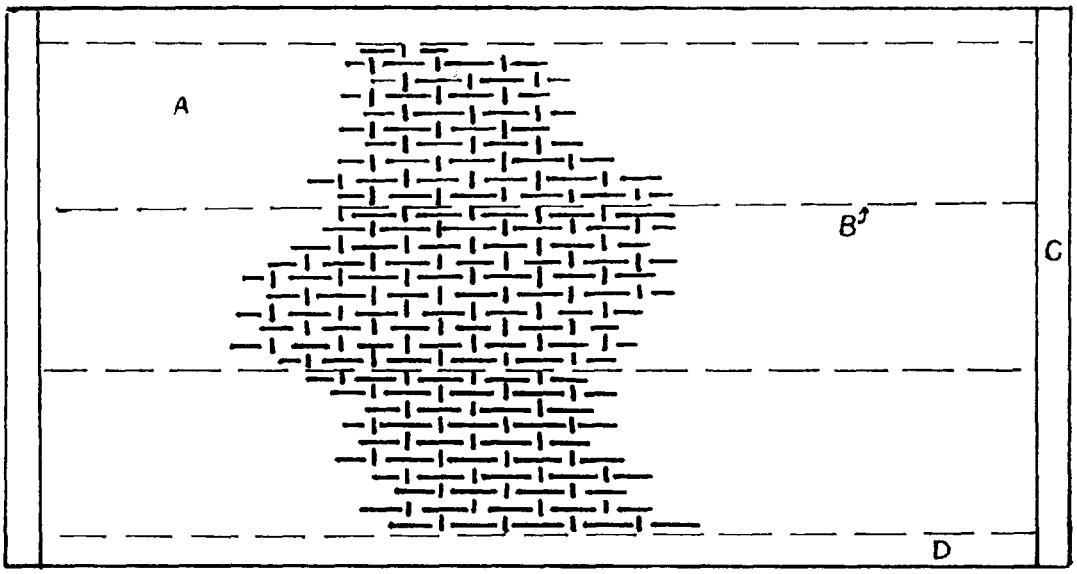
Figure 16:
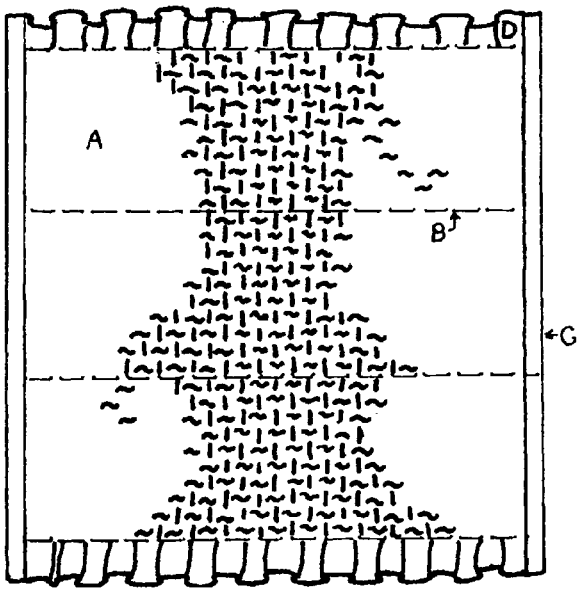

FIG. 16 illustrates the gathering floats on the plain weave for the pouch sites in the vest. Fabric A in the top and bottom view is woven with a plain basket weave (D) that incorporates a fill float (B) in a determined vertical distance. In this example the distance is approximately 1". The top view exhibits the fabric stretched at 100% of the bottom view (between the selvedges C). The bottom view is in the relaxed state.

Figure 17:
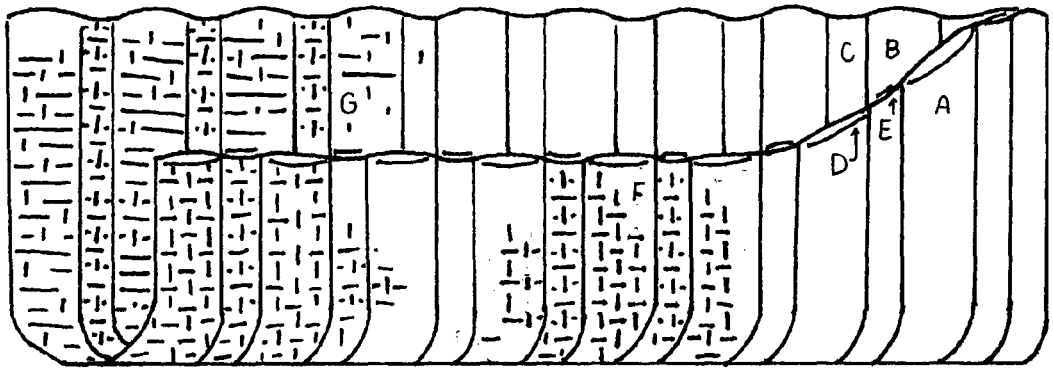
Figure 17:
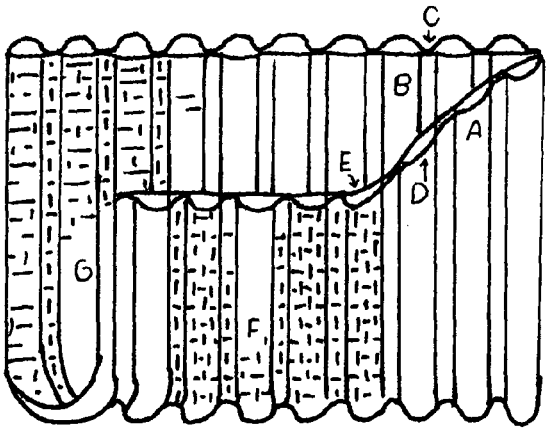

FIG. 17 illustrates the elastic banding created through differential shrinkage of two separate weaves. The face of one layer (F) is woven with a plain basket weave. It is backed with a second layer (G) in a modified crepe weave. Spaced evenly through the banding is a section that ties the two layers together in a plain weave (C). Pockets are created such that one side (A,D) of the untied section shrinks greater than the other side (B). When the band is relaxed, as shown in the lower illustration, a ribbed elastic band is created.

Figure 18:
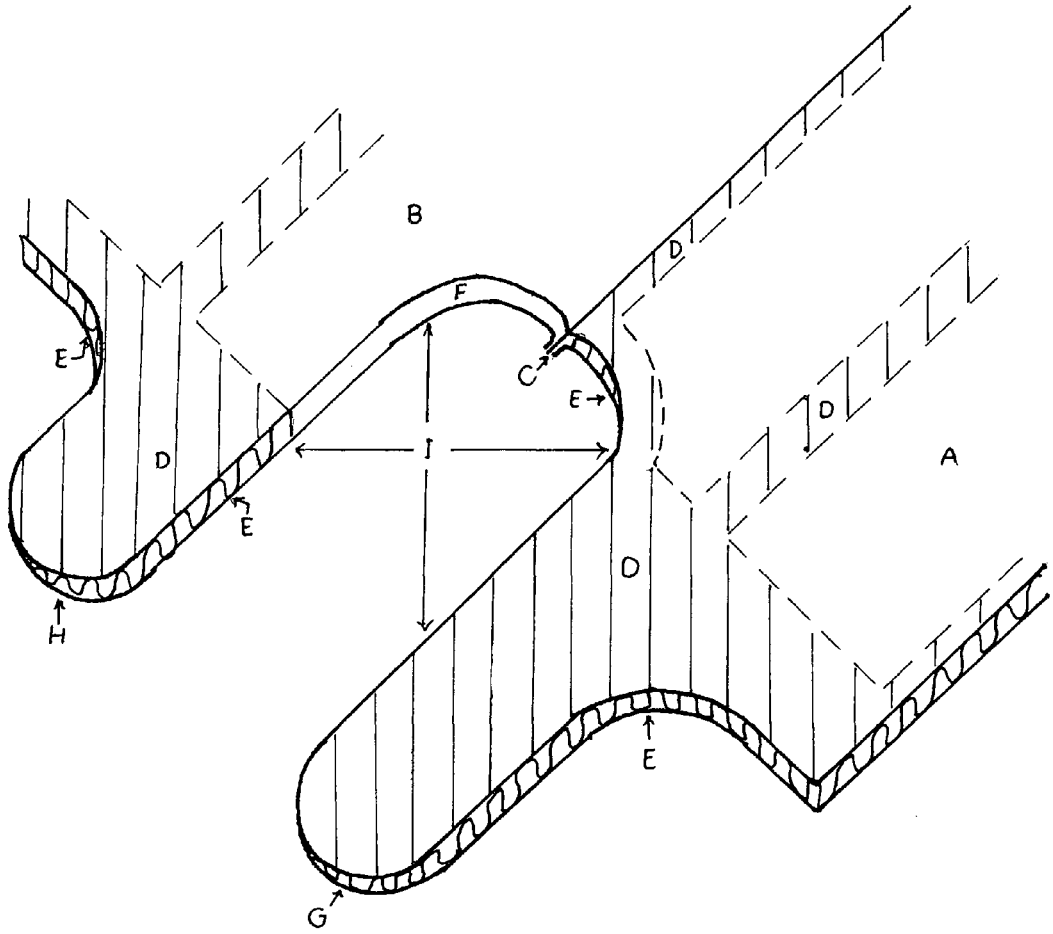

FIG. 18 shows the open portion of the armcye (I), the shoulders (G and H) and neckline of the two layers forming the front (A) and back (B) of the vest. The top and bottom layers are attached with a tie down (E) along the lined sections (D). The side seam for these two layers is show at site C.

Figure 19:
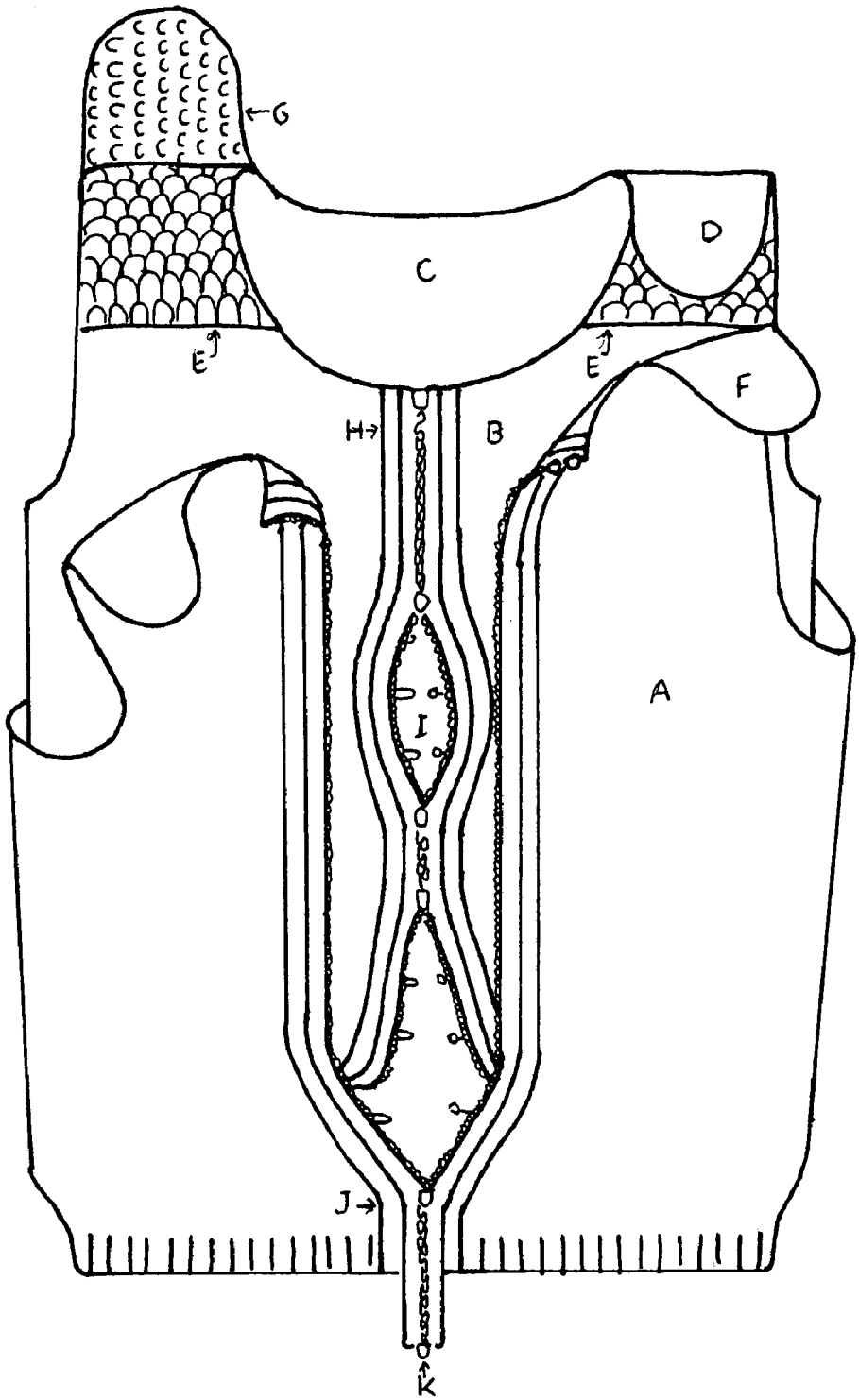

FIG. 19 illustrates the closure mechanisms for the front of the vest with the hip length vest (A) on the outside and the waist length vest (B) on the inside. The shoulder closures are insured with hook and loop. The hook (G) on the inside of the back of the shoulder (D) is sewn into place. The loop portion (E) is woven into the front shoulder (F). The zipper is supported for donning, site stops and failure by the buckles (I) on the back side of the zipper. They are attached to the zipper at the sewn site (J) which is the additional web attached to the zipper tape. The vest can be closed with the waist length only, the hip length only or both for shoulder and front zipper mechanisms.

The woven garment made in accordance with the present invention was woven on the equipment with the set up described below:

| | |
|---|---|
| Jacquard Machine | Staubli C880 size 2688 (Heads A & B) |
| Harnesses | 9600 with right, left and central guides |
| Loom Model | Some Thema II Electronic with single beam |
| Loom Width | 190 cm |
| Fill Insertion | Flexible rapier |
| Weft Selector | 8 color electro-magnetic synchronization |
| Selvedge | 210 mm spools with independent motion and cutters |
| Let Off/Take Up | Electronic with pick density 20.4 t 508 ppi |

The following steps have been followed for producing a woven garment in accordance with the present invention:

a. Design the garment function and size b. Choose the yarn construction and fiber content that will result in a high modulus (1-4), a stretch capacity of 100% to 250% and a denier sufficient to insure 95% recovery c. Establish the number of warp ends to be divided between the number of layers to be constructed d. Establish a specified distance between warp ends to allow for contraction and a specified stretch capacity e. Establish a pick count on each layer to achieve a specified compression capacity f. Establish the pick count of each layer to produce compatible interstices for weaving multiple layers together g. Create a Jacquard pattern for the entire length of the garment h. Create a Jacquard pattern for the width of the garment within a 13.5" cross machine repeat using mirror imaging for cut lines and construction details i. Set up the elastomeric yarns for the fill insertion on the feeders j. Weave the garment from the set design k. Remove from the cut roll and complete finishing operations as outlined in U.S. patent application Ser. No. 12/591,373 for: Process for Imparting High Stretch, Recovery and Modulus into a Woven Fabric, and l. Seal the edges of the armcyes and necklines m. Seal the pocket openings on the interior of the garment (created through pocket warp yarns as seen in FIG. 15) Complete the construction of the garment through the folding mechanisms outlined in FIGS. 5 & 6 on the fold lines created in the pattern on FIGS. 7 thru 14 n. Sew in hook component onto back inside shoulder placement areas per FIG. 19 o. Sew in zipper components in waist length vest interior with cummerbund per FIG. 19 p. Sew in zipper component on hip length vest exterior with bottom extension per FIG. 19 q. Sew in 2 mid line zipper components on exterior hip length vest per FIG. 2 r. Press fold lines

It will be apparent to one skilled in the art of weaving that the production of the garment is limited only to using a Jacquard machine with an electronic loom. The size, make and set up on the Jacquard machine and loom can be changed to provide additional advantages in the garment design and functionality.

The garment may be made of any elastomeric yarn that is applicable to the garment function. The choice of the yarn is ordinarily determined by comfort, compression or modulus, stretch capacity and growth or recovery. Additionally, performance characteristics would be incorporated that include: handle, thermal transfer, abrasion and pilling, tensile strength, tear strength, cut resistance and easy care. Suitable warp yarns would be nylon, polyester and polypropylene in spun or filament yarn construction. Fill yarns would find air-entangled, core spun and covered yarns with an elastomeric core and polyester, nylon, polypropylene or para-armid for the rigid component as suitable yarn constructions.

For the purposes of this garment having been produced in accordance with this invention the warp used a 90/33 texturized polyester. Four separate fill yarns were successfully used for different trials: 40D elastomeric/90D air-entangled filament polyester, 90D elastomeric/90D air-entangled filament polyester, 120D elastomeric/2/40D nylon double core spun, 156D elastomeric/100D texturized filament polyester covered. Each of the fill yarns were woven at 50 ppi, 60 ppi, 70 ppi, 80 ppi. All resulted in acceptable modulus between 1-4, all fabrics resulted in stretch capacities exceeding 200% with 90% recovery. The garment weight is finalized at 2.00 pounds including closure components.

The operation of the utility vest includes a modulus and stretch compatibility that will hold equipment and supplies close to the available surface area of the upper body. The garment has been fielded with weights up to 70 pounds and a hydration unit sized up to 11"×22". The placement of the articles according to weight, size and function are chosen by the wearer. The zippers give access to internal pouches available in the front and the back. The front 4 way zipper allows access to any portion of the vest while maintaining a closed vest position. The cummerbund provides additional pouches for internal concealment. All positions and sizes of the vest length, cummerbund, pouch size and position can be rearranged, resized and repositioned as those skilled in the art are aware.

What is claimed is:

1. A process for weaving a full fashioned garment comprising the steps of:

a. weaving at least two separate layers, to include at least one layer for the front and one layer for the back of the garment, and
b. weaving a connecting structure at the selvedges that interlaces the layers together to form a tubular structure in the machine direction, and
c. designing features that define the cutlines, size, and shape of the garment through pattern design on a Jacquard machine, and
d. using an elastomeric fill yarn that incorporates high stretch and compressive forces to the body with good recovery, and
e. using an elastomeric fill yarn that incorporates loop projections for hook and loop placement at the shoulder markers, and
f. weaving independent layered sections of the garment in the warp and fill direction to create pouches, and
g. weaving dependent layered sections of the garment in the warp and fill direction to create pouches, and
h. weaving differential compression layered sections in conjunction with dependent layered sections to create elastic banding, and
i. creating warp floats above second tiered layers to form pouch openings, and
j. weaving alternating basic weaves with lines of fill floats to create gathering, and
k. weaving a connecting structure between layers to establish stable areas for placement of closures and fasteners, and
l. using an elastomeric fill yarn that incorporates high stretch and compressive forces to the objects in the pouches with good recovery.

2. A process according to claim 1 wherein the step of weaving the tubular structure includes interlacing the warp and fill yarns on all layers at the fabric selvedge which incorporates a leno weave.

3. A process according to claim 1 wherein the yarn in the fill direction comprises an elastomeric yarn with the capability of providing a predetermined compression in relation to the function of the garment.

4. A process according to claim 1 wherein the step of weaving each layer structure results in Jacquard patterning necessary for fashioned garment formation including necklines, armcyes, shaping, sizing and design features.

5. A full fashion stretch woven garment comprising:

a. multiple layers and pouches that accommodate various sizes of supplies and equipment, and
b. multiple layers and pouches that compress the weight of selected supplies and equipment close to the body without discomfort, and
c. woven joining constructions that trap and stabilize elastomeric yarns up to 1.0 modulus, and
d. at least two separate layers, to include at least one layer for the front and one layer for the back of the garment, and
e. a connecting structure at the selvedges that interlaces the layers together to form a tubular structure in the machine direction, and
f. design features that define the cutlines, size, and shape of the garment through pattern design on a Jacquard machine, and
g. an elastomeric fill yarn that incorporates high stretch and compressive forces to the body with good recovery, and
h. an elastomeric fill yarn that incorporates high stretch and compressive forces to the objects in the pouches with good recovery, and
i. an elastomeric fill yarn that incorporates loop projections for hook and loop placement at the shoulder markers, and
j. differential compression layered sections in conjunction with dependent layered sections to create elastic banding, and
k. warp floats above second tiered layers to form pouch openings, and
l. alternating basic weaves with lines of fill floats to create gathering, and
m. a connecting structure between layers to establish stable areas for placement of closures and fasteners.

6. A woven garment as defined in claim 5 wherein the edges of necklines, armcyes and pouch openings are sealed with thermal or ultrasonic garment forming operations.

7. A woven garment as defined in claim 5 wherein a four way separating zipper with hooped closures provides a means to accommodate donning, disrobing, exterior access to interior pouches, and provides a backup for zipper failure.

8. A woven garment as defined in claim 5 wherein one way non separating zippers on the back of the exterior layer allows for interior access to pouches.

9. A woven garment as defined in claim 5 wherein adjustable shoulder straps forming loops with air-entangled yarns provide for the hook side placement.

10. A woven garment as defined in claim 5 wherein the step of weaving the tubular structure includes interlacing the warp and fill yarns on all layers at the fabric selvedge which incorporates a leno weave.

11. A woven garment as defined in claim 5 wherein the yarn in the fill direction comprises an elastomeric yarn with the capability of providing a predetermined compression in relation to the function of the garment.

12. A woven garment as defined in 5 wherein the step of weaving each layer structure results in Jacquard patterning necessary for fashioned garment formation including necklines, armcyes, shaping, sizing and design features.

* * * * *